United States Patent [19]

Brown

[11] 4,426,800

[45] Jan. 24, 1984

[54] FLEXIBLE SIGN WITH IMPROVED CORNER BRACKET

[76] Inventor: Herman O. Brown, 110 Cedar Ct., Marietta, Ga. 30067

[21] Appl. No.: 373,656

[22] Filed: Apr. 30, 1982

[51] Int. Cl.[3] ..... G09F 7/02; G09F 17/00

[52] U.S. Cl. ..... 40/606; 40/603; 40/610; 40/611; 40/612; 116/63 P; 116/173; 244/153 R

[58] Field of Search ..... 40/603, 605, 606, 610, 40/607, 611, 612, 155; 116/63 P, 173; 224/153 R, 155 A

[56] References Cited

U.S. PATENT DOCUMENTS

| | | | |
|---|---|---|---|
| 1,873,178 | 8/1932 | Bernstein | 40/603 |
| 2,484,096 | 10/1949 | Kay | 244/153 R |
| 3,143,817 | 8/1964 | Paulson | 40/606 |
| 3,200,786 | 8/1965 | Swezy et al. | 40/610 |
| 3,526,200 | 9/1970 | Doyle | 40/606 |
| 3,899,843 | 8/1975 | Doyle et al. | 40/612 |
| 4,015,802 | 4/1977 | Heredia | 244/153 R |

*Primary Examiner*—Gene Mancene
*Assistant Examiner*—James Hakomaki
*Attorney, Agent, or Firm*—Jones & Askew

[57] ABSTRACT

A flexible message sign particularly intended for highway or roadway applications, and having improved corner brackets. Each corner bracket is made of rigid members which sandwich and securely engage corners of the flexible fabric or other material from which the sign is made. Each corner bracket provides a channel for removably holding ends of frame members which maintain the flexible message panel in message displaying configuration. The frame-receiving channels maintain the frame ends out of contact with the flexible message panel, so that the panel cannot become ripped or torn by engagement with the frame ends.

5 Claims, 4 Drawing Figures

FLEXIBLE SIGN WITH IMPROVED CORNER BRACKET

FIELD OF INVENTION

This invention relates in general to flexible signs, and relates in particular to flexible safety signs intended for temporary or emergency message markers and the like.

BACKGROUND OF THE INVENTION

Traffic safety signs are widely used to inform motorists and pedestrians of traffic conditions, right-of-way, and other information required for maintaining a safe and orderly flow of traffic. Although most traffic safety signs are permanently installed at particular locations and are made of relatively heavy durable materials such as metal or the like, the need exists for portable safety signs which may be temporarily placed where needed. Such portable safety signs might be used, for example, at the site of an accident to warn oncoming motorists, or to indicate a temporary detour around a hazardous or unsafe roadway condition.

The weight and size of the typical permanent traffic safety sign makes such signs relatively undesirable for temporary or emergency applications. The typical diamond-shaped traffic information sign in a size larger enough to catch the attention of oncoming motorists at highway speeds is relatively large, e.g., several feet per side; conventional rigid highway signs of that size cannot easily fit in automobiles and other emergency vehicles, and are relatively heavy and awkward to manipulate.

In an effort to overcome the foregoing problem, prior art safety signs have been made of flexible fabric materials such as plastic mesh or a reflective flexible material sold under the trademark Reflexite. The desired background color and signage indicia are applied to the front side of the flexible material, and corner pockets are stitched to the back side of the flexible material at each corner. Elongated frame members engage these corner pockets and attempt to maintain the flexible sign in a substantially flat configuration when in use. The frame members are removed from the pockets when the sign is not in use, allowing the fabric material to be folded or rolled into a relatively compact package for stowing in an automobile trunk or a relatively small storage compartment of a safety vehicle.

Such flexible safety signs, while overcoming the weight and size disadvantages of conventional rigid signs, have proven less than satisfactory for various reasons. For example, the ends of the rigid supporting frame members can rip or tear the flexible fabric sign material as the frame ends are inserted or removed from the retaining pockets on the back of the flexible sign. Moreover, these flexible signs typically are supported by metal sign stands which tend to rip or otherwise damage the corners of the fabric sign material. The sewn-on pockets for retaining the frame members tend to provide a wrinkled or limp appearance at the sign corners, thus providing an unattractive or undesirable appearance which may detract from the desired attention-getting warning purpose of these signs.

SUMMARY OF INVENTION

Accordingly, it is an object of the present invention to provide an improved flexible safety sign.

It is another object of the present invention to provide an improved corner bracket for use with a flexible safety sign.

It is still another object of the present invention to provide a flexible safety sign having an improved corner bracket which supports the sign more rigidly, and which prevents tearing or damaging of the sign material.

Stated in general terms, the foregoing and other objects of the present invention are provided by a safety sign corner bracket which secures to the flexible sign panel at a corner or other selected location, thereby defining a receptacle for removably receiving an end of a frame or supporting member which holds the sign in a relatively flat message displaying configuration. The bracket maintains the frame ends out of contact with the flexible material of the sign, so that the sign cannot be cut or otherwise damaged by the frame ends as the flexible sign is assembled or disassembled.

Stated somewhat more specifically, each bracket of the present flexible sign engages a local region at the periphery of the flexible panel making up the sign. Each bracket includes a frame-receiving receptacle isolated from the surface of the flexible panel. The brackets may include rigid portions engaging both front and back surfaces of the flexible sign at the local region thereof, to maintain the flexible sign material in the desired flat configuration as the sign is supported in message displaying configuration by the frame members.

Other features and advantages of the present invention will become more readily apparent from the following discussion of preferred disclosed embodiments.

DESCRIPTION OF PREFERRED EMBODIMENTS

Figure 1:
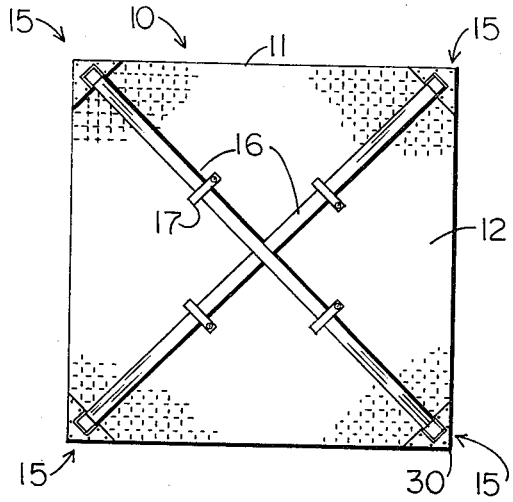
FIG. 1 is an elevation view showing the back side of a flexible sign according to a first disclosed embodiment of the present invention.
Figure 2:
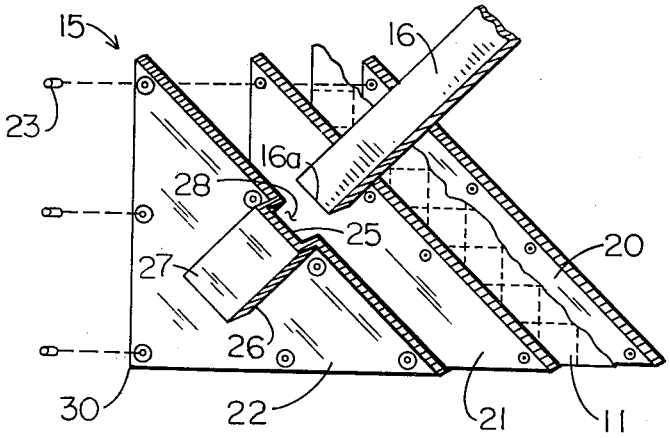
FIG. 2 is an exploded view showing one of the corner brackets used with the sign shown in FIG. 1.
Figure 3:
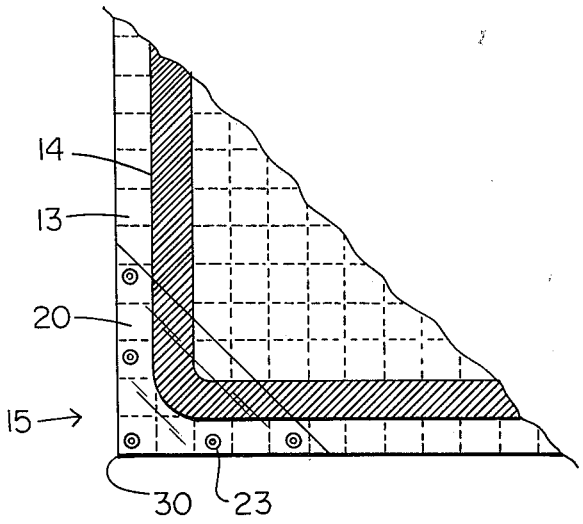
FIG. 3 is a fragmentary enlarged front view of the sign shown in FIG. 1, including one corner bracket thereof.

Turning first to FIGS. 1–3, there is shown generally at 10 a flexible sign according to a disclosed first embodiment of the present invention. The sign 10 includes a flexible message panel 11 made of a suitable easily-foldable material such as plastic mesh or the like. The message panel material preferably should be relatively durable when exposed to rain, sunlight, and like elements, yet should be easily rolled or folded to occupy a reduced space when the sign is not in use. Such flexible sign materials are known to those skilled in the art.

The flexible message panel 11 has a back side 12 (FIG. 1), and a front side 13 (FIG. 3) onto which the desired sign indicia and/or message are applied by any suitable printing technique. For example, the front side 13 preferably has a highly-reflective surface of a traditional highway sign color such as yellow or the like, with a black peripheral border 14 defining the message area within that border. The particular chosen warning symbol or message (not shown) is placed within the border 14 in the conventional manner.

Returning to FIG. 1, it is seen that the sign 10 has an identical bracket 15 at each of the four corners of the sign. Two separate elongated and rigid frame members 16 extend diagonally in X-configuration across the back side 12 of the sign. The ends of these frame members 16 removably fit within receptacles defined in the brackets 15, and it will be understood that the frame members maintain the flexibl message panel 11 in a substantially flat message displaying configuration. It will also be understood that the two frame members 16 can be removed from the respective brackets 15, allowing the flexible message panel 11 to be rolled or folded to a relatively small overall size for stowage.

A plurality of frame engaging straps 17 are secured to the back side 12 of the message panel 11 in position to engage the frame members 16 approximately midway between the corner brackets 15 and the crossover of the two frame members. These frame straps 17, shown at FIG. 1 in frame engaging relation, can simply be elongated strips of fabric having one end secured to the back side 12 of the message panel and having a free end to wrap around the back of the respective overlying frame member 16. A snap or other suitable securement maintains each strap 17 in the frame-engaging relation shown in FIG. 1, and it will be understood that the straps are unsnapped or otherwise disconnected to permit removal of the frame members. These frame straps hold the message panel 11 to the frame members 16 in assembly, preventing the message panel from flapping or billowing in a breeze and thus enhancing the overall appearance of the sign 10.

Turning next to FIG. 2, a typical corner bracket 15 is shown in greater detail. The corner bracket includes a rigid front member 20 pressed against the front side 13 of the message panel 11 at a local region adjacent one corner 30 thereof, and a back portion including the back members 21 and 22 sandwiched together against a corresponding area on the back side 12 of the message panel. The first back member 21 comprises a rigid flat panel preferably corresponding in overall configuration to the shape of the front member 20. The second back member 22 preferably also corresponds in overall shape to the configuration of the first member 21 and the front member 20. However, the second member 22 is formed to define a channel 25 configured to receive the end **16*a* of a frame member 16, as illustrated in FIG. 2**.

The channel 25 extends back from the confronting rear surface 28 of the first back member 21, and this channel is defined by a pair of raised walls 26 and the bottom wall 27 formed in the second back member 22 of the bracket 15. The entire second member 22 preferably is molded or otherwise formed from a rigid material such as a suitale plastic or the like, so that the raised walls 26 and bottom wall 27 defining the channel 25 are unitary with the remainder of the second member 22. The first back member 21 and the front member 20 preferably are also made of a similar rigid material, providing strength and durability to the corner bracket 15 while minimizing the weight of the bracket.

The three members 20, 21, and 22 comprising the corner bracket 15, together with the corner portion of the message panel 11, are retained in assembly by a plurality of rivets 23 extending through mating holes in the rigid members and the message panel. It will thus be seen that each bracket 15 provides a channel 25 for removably receiving an end **16*a* of a frame member 16. Each such channel 25 is defined on three sides by the second back member 22, and on the fourth side adjacent (but not contacting) the flexible message panel 11 by the confronting rear surface 28 of the first back member 21. The frame end 16*a* thus fits within the channel 25 isolated out of possible contact with the message panel 11, so that the message panel cannot be ripped or torn as the frame end is inserted into or withdrawn from the corner bracket 15. Moreover, each corner 30 of the message panel 11 is maintained fully spread out by a corner bracket 15, eliminating the wrinkled appearance commonly associated with the stitched pockets used in flexible signs of the prior art. It will also be appreciated that the relatively rigid and durable brackets 15 at the corners 30 of the sign eliminate the need for unsightly stitching on the front side 13** of the message panel at the corners, and prevent those corners from being ripped or otherwise damaged by metal sign stands or the like.

Figure 4:
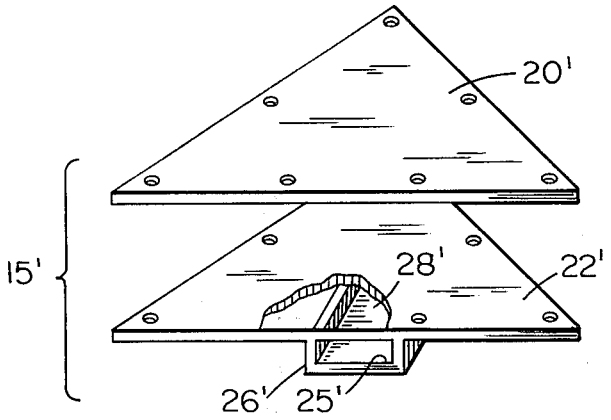
FIG. 4 is an exploded view showing a sign corner bracket according to an alternative embodiment of the present invention.

Turning next to FIG. 4, there is shown an alternative embodiment 15' of a corner bracket in which primed numerals represent elements comparable to their unprimed counterparts in the previously described embodiment. The corner bracket 15 includes a front member 20' which fits against a corresponding local portion (not shown) of a message panel, and a single back member 22' which replaces the first and second back members 21 and 22 of the previous embodiment. Both the front member 20' and the back member 22' preferably are made of rigid material such as plastic or the like, and both members preferably have the same overall planview configuration. The two members are secured to the corner of the message panel by rivets (not shown) or other suitable fasteners.

The channel 25' is integrally formed on the back side of the second member 22'. This channel 25', including the raised walls 26' and bottom wall, preferably is molded or otherwise formed as an integral portion of the member 22'. The bottom surface 28' of the channel 25' thus is the back surface of the member 22', in contrast with the confronting surface 28 provided by the separate first back member 21 with the preceding embodiment illustrated in FIG. 2. The channel 25', as with the channel 25 in the preceding embodiment, is configured to provide a snug yet easily-removable sliding fit with the end of a frame member.

It can thus be seen that the alternative embodiment of corner bracket 15' provides substantially the same advantages as the preceding embodiment, with the added advantage of being assembled from two separate elements. A frame member inserted in the channel 25' is maintained in isolation and out of contact with the message panel sandwiched between the front portion 20' and back portion 22', thereby preventing ripping or other damage to the message panel. Furthermore, the rigid members 20' and 22' of the bracket 15' maintain the flexible message panel in a flat and spread-out configuration, preventing wrinkling and the like as the sign is maintained in message displaying configuration.

It will also be understood that the foregoing relates but to preferred embodiments of the present invention, and that numerous changes and modifications may be made therein without departing from the spirit and scope of the invention as defined by the following claims.

I claim:

1. A flexible safety sign comprising:

a flexible message panel capable of assuming a substantially flat message displaying configuration;

at least one brackt means engaging a local region at the periphery of said flexible panel and defining a receptacle isolated from the surface of the flexible panel;

a frame member having an end removably insertable in said receptacle, and, when inserted, maintaining said flexible panel in the message displaying configuration with the end out of contact with the flexible panel, thereby preventing damage to the flexible panel by the frame member end, said bracket means comprising a rigid back portion having a front side disposed against one side of the flexible panel, and having a back side;

a rigid front portion disposed against the other side of the flexible panel coextensive with said back portion so as to sandwich said local region of the flexible panel between the front and back rigid portions;

means joining said first and second portions with said local flexible panel region retained therein; and said back portion having rigid means defining said receptacle on said back side so as to maintain said frame member end in spaced apart relation from said flexible panel.

2. The sign as in claim 1 wherein:

said back portion comprises a first rigid member contacting said flexible panel along said local region and having a surface on said back side facing away from the panel, and a second member disposed on said back side surface of the first member; and said second member having a confronting surface disposed against said back side surface of said first member, and further having an integral portion spaced outwardly from said back side surface to define a frame-receiving channel between said second member and the first member; and said channel and the frame member end receivable therein being separated from the flexible panel by said first rigid first member.

3. The sign as in claim 1, wherein:

said receptacle defining means is spaced outwardly from said back side, so that the frame member end removably fits in fixed engagement within the receptacle and is there maintained spaced apart from the flexible panel by said rigid back portion.

4. The sign as in claim 1, wherein:

said flexible message panel includes a plurality of corners separately having a bracket means engaging a local region of the message panel adjacent the respective corners; and said receptacles of the bracket means are configured to closely surround and engage the ends of corresponding frame members in fixed predetermined relation substantially parallel to the substantially flat configuration of the message sign, so that the frame members maintain the flexible message panel in the substantially flat message displaying configuration, and the frame members and rigid portions of the bracket means maintain said corners in substantially flat parallel relation to the remainder of the message panel.

5. Highway sign apparatus of the kind including a flexible message panel having corners, stiffening means associated with said corners, and a corner bracket affixed to the flexible message panel at least at one corner thereof, said corner bracket comprising:

a rigid front corner member having a flat back surface contacting a corner portion of the flexible panel on the front side thereof;

the shape of said flat surface being substantially the same as the corner configuration of the panel;

a rigid back corner member having a flat front surface contacting said corner of the flexible panel on the back side thereof;

said back corner member being substantially contiguous with said flat surface of said front corner member, so that said corner portion is sandwiched flat between said flat surfaces of said front and back corner members; and means on the back side of said back corner member defining a rigid socket having an elongated channel substantially parallel to said flat surfaces, so that stiffening means associated with said sign apparatus can be inserted in aid rigid socket.

* * * * *